US006247416B1

(12) United States Patent
Beaudoin et al.

(10) Patent No.: US 6,247,416 B1
(45) Date of Patent: Jun. 19, 2001

(54) METHOD OF OPERATING A FURNACE AND DEVICE FOR IMPLEMENTING THE METHOD

(75) Inventors: Philippe Beaudoin, Monheim (DE); Benoit Loiselet, Bois D'arcy (FR)

(73) Assignee: L'Air Liquide Societe Anonyme pour l'Etude et l'Exploitation des Procedes Georges Claude, Paris Cedex (FR)

( * ) Notice: Subject to any disclaimer, the term of this patent is extended or adjusted under 35 U.S.C. 154(b) by 0 days.

(21) Appl. No.: 09/276,675

(22) Filed: Mar. 26, 1999

(30) Foreign Application Priority Data

Apr. 2, 1998 (FR) ..... 98 04115

(51) Int. Cl.[7] ..... F23N 5/02
(52) U.S. Cl. ..... 110/190; 110/186; 431/68
(58) Field of Search ..... 110/185, 186, 110/188, 190; 431/68; 236/15

(56) References Cited

U.S. PATENT DOCUMENTS

Re. 34,298 * 6/1993 Gitman et al. ..... 431/5
4,649,834 * 3/1987 Heran et al. ..... 110/190
5,832,842 * 11/1998 Frontini et al. ..... 110/190

FOREIGN PATENT DOCUMENTS

0160884 * 11/1985 (EP) ..... 236/15
0 553 632 A2 8/1993 (EP) .
2 128 776 * 5/1984 (GB) ..... 236/15
06313542 * 8/1994 (JP) ..... 431/68
WO 96/06432 6/1990 (WO) .

* cited by examiner

*Primary Examiner*—Denise L. Ferensic
*Assistant Examiner*—K. B. Rinehart

(57) ABSTRACT

The invention relates to a method of operating a furnace (1) comprising a flue pipe (11) for discharging the smoke, means (19) of introducing ambient air into the said flue pipe (11) and a smoke extractor (16) arranged in the said flue pipe (11). According to the method, the temperature of the smoke is measured at two points (31, 33), the temperature measured at the second point (33) is subtracted from the one measured at the first point (31), the result of the subtraction is compared with a datum value ΔT, and the ratio of the flow rate of fuel to the flow rate of oxidizing agent introduced into the furnace (1) is decreased when the result of the subtraction is below the datum value ΔT.

10 Claims, 1 Drawing Sheet

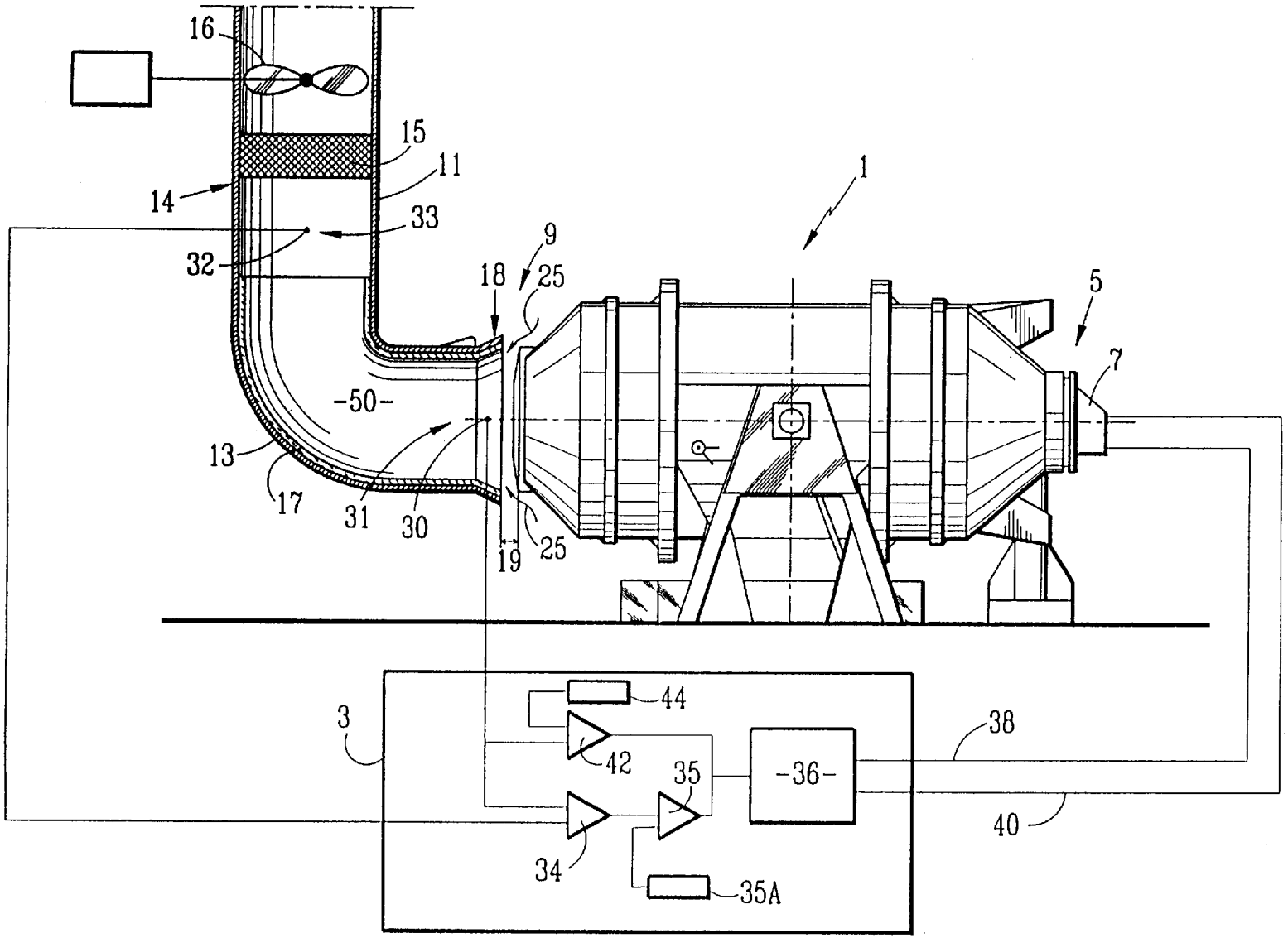
1
5
7
9
11
13
14
15
16
17
18
19
25
25
30
31
32
33
-50-
38
40
-36-
35A
35
44
42
34
3

METHOD OF OPERATING A FURNACE AND DEVICE FOR IMPLEMENTING THE METHOD

This application claims priority under 35 U.S.C. §§119 and/or 365 to 98 04115 filed in France on Apr. 2, 1998; the entire content of which is hereby incorporated by reference.

BACKGROUND OF THE INVENTION

1. Field of the Invention

The invention relates to a method of operating a furnace such as, for example, a rotary oxycombustion furnace, comprising an elbowed flue pipe for discharging the smoke at the furnace outlet, means of introducing ambient air into the said flue pipe and a smoke extractor arranged in the flue pipe, downstream of the said means of introducing ambient air.

2. Description of the Related Art

Methods of running such a furnace are known, and in these methods, in a first step, a gas analyser is used to analyse the, for example, CO content of the smoke and, in a second stage, the amounts of fuel and of oxidizing agent introduced into the furnace are adjusted as a function of the measurement result obtained.

These methods of operating a furnace using a gas analyser have the drawback of being expensive and complex.

This is because gas analysers are technologically advanced measurement instruments which are therefore very expensive, especially where highly reliable and very accurate analysers are concerned.

Furthermore, because of the construction and operation of a gas analyser, the measurement results it yields drift over time, which means that the analyser requires regular calibration.

Added to this is the fact that this gas analyser requires the attention of a specially qualified operator to maintain this measurement instrument and keep it operating correctly.

The invention sets out to alleviate these various drawbacks by proposing a method of operating a furnace and a device for implementing this method which is reliable and of low cost.

SUMMARY OF THE INVENTION

To this end, the subject of the invention is a method of operating a furnace comprising a flue pipe for discharging the smoke, means of introducing ambient air into the said flue pipe and a smoke extractor arranged in the said flue pipe, downstream of the said means of introducing ambient air, characterized in that:

- the temperature of the smoke is measured at two points, one of which is close to the outlet of the furnace, and the other of which is in the flue pipe, downstream of the first point,
- the temperature measured at the second point is subtracted from the one measured at the first point,
- the result of the subtraction is compared with a positive or zero datum value ΔT, and
- the ratio of the flow rate of fuel to the flow rate of oxidizing agent introduced into the furnace is decreased when the result of the subtraction is below the datum value ΔT.

The method according to the invention may additionally comprise one or more of the following features:

- the datum value ΔT corresponds to the difference between the temperature of the smoke at the first point and that at the second point when the furnace is running optimally,
- the datum value ΔT is equal to zero,
- after the said reduction, the temperature measured at the first point is also compared with a reference temperature and the ratio of the flow rate of fuel to the flow rate of oxidizing agent introduced into the furnace is increased when the temperature of the smoke measured at the first point is below the reference temperature.

Another subject of the invention is a device for operating a furnace comprising a flue pipe for discharging the smoke, means of introducing ambient air into the said flue pipe and a smoke extractor arranged downstream of the said means of introducing ambient air, for implementing the method as defined hereinabove, characterized in that it further comprises a first and a second sensor for measuring the smoke temperature, the first of which is placed close to the outlet of the furnace, and the second of which is placed in the flue pipe, downstream of the first sensor, means of subtracting the temperature measured by the second sensor from the one measured by the first sensor, means of comparing the result of the subtraction with a datum value ΔT and, controlled by the said comparison means, means of reducing the ratio of the flow rate of fuel to the flow rate of oxidizing agent introduced into the furnace when the result of the subtraction is below a datum value.

The device according to the invention may additionally comprise the feature whereby it additionally comprises means of storing a reference temperature, means of comparing the temperature measured by the first sensor with the reference temperature and, controlled by the said means of comparing the temperature measured by the first sensor with the reference temperature, means of increasing the ratio of the flow rate of fuel to the flow rate of oxidizing agent introduced into the furnace when the smoke temperature measured by the first sensor is below the reference temperature.

BRIEF DESCRIPTION OF THE FIGURE OF THE DRAWING

Other features and advantages of the invention will emerge from the following description, given by way of non-limiting example, with reference to the appended drawing which depicts a diagram of an oxycombustion rotary furnace equipped with a device according to the invention.

DETAILED DESCRIPTION OF THE PREFERRED EMBODIMENTS

The single figure depicts an oxycombustion rotary furnace 1 equipped with an operating device 3 according to the invention.

The furnace 1 comprises an inlet 5 which has a burner 7 via which an oxidizing agent such as, for example, oxygen or oxygen-enriched air, and a fuel, for example natural gas, are introduced into the furnace 1, and an outlet 9 via which the smoke, that is to say the products of combustion, are discharged towards a flue pipe 11.

The flue pipe 11 comprises an elbowed portion 13 which is extended by a vertical portion 14 in which a filter 15 followed by an extractor 16 are arranged.

The extractor 16 sucks the smoke leaving the furnace 1 into the flue pipe 11 and ejects this smoke, once filtered, out into the surrounding atmosphere.

In order to be able to withstand the high temperature of the smoke leaving the furnace, the internal walls of the elbowed portion 13 are lined with a refractory material 17.

Furthermore, the inlet 18 of the elbowed portion 13 has a shape which widens towards the outlet 9 of the furnace 1 and is arranged facing it from a distance, with a certain gap 19 in between.

The gap 19 between the inlet 18 of the flue pipe 11 and the outlet 9 of the furnace 1 acts as a means of introducing ambient air into the flue pipe 11 to cool the smoke leaving the furnace 1 before this smoke reaches the filter 15 arranged further downstream.

The device 3 for operating the furnace 1 comprises a first temperature sensor 30 arranged at a first point 31 close to the outlet 9 of the furnace, that is to say either directly in this outlet or, as has been depicted in the drawing, just at the inlet 18 of the elbowed portion 13 of the flue pipe 11. As a preference, the sensor 30 is centred in the inlet 18 so that it does not come into contact with the ambient air (indicated by arrows 25) which enters the flue pipe 11 from the side under the effect of the suction of the extractor 16.

The device 3 for operating the furnace 1 additionally comprises a second temperature sensor 32 arranged at a second point 33 centred in the flue pipe 11 downstream of the first point 31, preferably after the elbowed part 13 of the flue pipe 11.

The temperature sensors 30 and 32 consist for example of thermocouples.

Each sensor 30, 32 is connected to one input of a subtractor 34, whose result—the subtraction of the temperatures delivered by the sensors 30 and 32—is compared in a first comparator 35 with a positive or zero datum value $\Delta T$ stored in a memory 35A. As a preference, the datum value $\Delta T$ is a value determined experimentally and which corresponds to the difference in temperatures at the first point 31 and at the second point 33, respectively, when the furnace is at optimal settings. In this context, it is considered that the furnace is at optimal settings when its efficiency is at a maximum, which occurs when, on the one hand, there is no excess of oxygen cooling the furnace and, on the other hand, the CO content in the smoke leaving the furnace is at a minimum. However, this datum value may also be equal to zero in a simplified embodiment of the invention. Depending on the result of the comparison, the comparator 35 controls the means 36 of regulating the flow rates of oxidizing agent and of fuel introduced into the furnace 1 via a line 38 for controlling the flow rate of oxidizing agent and a line 40 for controlling the flow rate of fuel, both connected to the burner 7.

Incidentally, the device 3 comprises a second comparator 42, a first input of which is connected to the sensor 30 and a second input of which is connected to means 44 of storing a reference temperature. The output of the second comparator 42 is also connected to the regulating means 36 so as to control these as a function of the result of the comparison between the temperature delivered by the sensor 30 and the reference temperature stored in the memory 44.

The running of the method for operating the furnace 1 according to the invention and the operation of the device 3 for implementing this method, are described hereafter.

When the furnace 1 is in operation, a certain oxidizing agent/fuel mixture is introduced into the furnace 1 via the burner 7, this mixture being regulated by the means 36 of regulating the flow rates. This mixture may be characterized by the ratio of the flow rate of fuel to the flow rate of oxidizing agent introduced into the furnace 1.

Apart from when the furnace is operating at optimal settings, there are, in particular, two reduced-efficiency modes of operation of the furnace that can be considered.

Firstly, when the mixture introduced into the furnace 1 has an excess of fuel, there is not enough oxygen to be able to burn all of the fuel introduced into the furnace 1, which means that the CO content of the smoke increases. The smoke sucked into the flue pipe 11 mixes with the ambient air introduced. Because of the high temperature of the smoke and the presence of the oxygen in the air, the CO burns in a region 50 known as the post-combustion region, and this causes the temperature of the smoke in the portion 13 to rise to a higher level, particularly a level that is higher than that of the smoke leaving the furnace 1.

Secondly, when the oxidizing agent/fuel mixture introduced into the furnace 1 has too great an amount of oxidizing agent, the furnace becomes cooled which, for example in the case of a smelting furnace, increases the smelting time and thus the running cost of the installation.

To correct the excess fuel, the method according to the invention consists in measuring, on the one hand, by means of the sensor 30, the temperature of the smoke leaving the furnace 1, and on the other hand, downstream of the sensor 30 and using the sensor 32, the temperature of the smoke downstream of the region 50 in which post combustion may occur. The temperature measured by the sensor 32 is subtracted from the one measured by the sensor 30 using the subtractor 34. The result of the subtraction is compared with the datum value $\Delta T$ in the device 3 using the comparator 35.

If the result of the subtraction is below the datum value $\Delta T$, or even negative, which means that post combustion has taken place between the two points where the temperature is measured because of a high CO content in the smoke leaving the furnace 1 and as a result of an excess of fuel, the comparator 35 commands a reduction in the ratio of the flow rate of fuel to the flow rate of oxidizing agent introduced into the furnace by means 36. This reduction in the ratio between the two flow rates can be achieved either by increasing the flow rate of oxidizing agent or by decreasing the flow rate of fuel introduced into the furnace.

So, to avoid excess oxidizing agent, the temperature measured by the sensor 30 is also compared with the reference temperature stored in the memory 44. This reference temperature is a temperature value found by experimentation and which corresponds to the temperature of the smoke leaving the furnace when the latter is operating at optimal settings.

If the comparison by the comparator 42 reveals that the temperature measured by the sensor 30 is below the reference temperature, which means that an excess of oxidizing agent has been introduced into the furnace 1, the comparator 42 commands the means 36 to increase the ratio of the flow rate of fuel to the flow rate of oxidizing agent introduced into the furnace, and this is achieved either by reducing the flow rate of oxidizing agent or by increasing the flow rate of fuel.

In order to confine the furnace to a certain operating range, it is also possible within the regulating means 36 to define minimum and maximum flow rates for the oxidizing agent and for the fuel.

It can therefore be seen that the method according to the invention and the device for implementing it require only a relatively low investment. Furthermore, the hardware used, particularly the thermocouples, has the advantage of being robust and easy to install and maintain.

We claim:

1. Method of operating a furnace (1) comprising a flue pipe (11) for discharging the smoke, means (19) of introducing ambient air into the said flue pipe (11) and a smoke extractor (16) arranged in the said flue pipe (11), downstream of the said means (19) of introducing ambient air, characterized in that the temperature of the smoke is measured at two points (31, 33), one (31) of which is close to the outlet (9) of the furnace (1), and the other (33) of which is in the flue pipe (11), downstream of the first point (31), the temperature measured at the second point (33) is subtracted from the one measured at the first point (31), the result of the subtraction is compared with a positive or zero datum value ΔT, and the ratio of the flow rate of fuel to the flow rate of oxidizing agent introduced into the furnace (1) is decreased when the result of the subtraction is below a datum value ΔT and wherein the temperature measured at the first point (31) is also compared with a reference temperature and in that the ratio of the flow rate of fuel to the flow rate of oxidizing agent introduced into the furnace (1) is increased when the temperature of the smoke measured at the first point (31) is below the reference temperature.

2. Method according to claim 1, characterized in that the datum value ΔT corresponds to the difference between the temperature of the smoke at the first point (31) and that at the second point (33) when the furnace is running optimally.

3. Method according to claim 1, characterized in that the datum value ΔT is equal to zero.

4. Device for operating a furnace comprising a flue pipe for discharging the smoke, means (19) of introducing ambient air into the said flue pipe (11) and a smoke extractor (16) arranged downstream of the said means (19) of introducing ambient air, for implementing the method according to claim 1, characterized in that it further comprises a first and a second sensor (30, 32) for measuring the smoke temperature, the first (30) of which is placed close to the outlet (9) of the furnace, and the second (32) of which is placed in the flue pipe (11), downstream of the first sensor (30), means (34) of subtracting the temperature measured by the second sensor (32) from the one measured by the first sensor (30), means (35) of comparing the result of the subtraction with a datum value ΔT and, controlled by the said comparison means (35), means (36) of reducing the ratio of the flow rate of fuel to the flow rate of oxidizing agent introduced into the furnace (1) when the result of the subtraction is below a datum value.

5. Device for operating a furnace (1) according to claim 4, characterized in that it additionally comprises means (44) of storing a reference temperature, means (42) of comparing the temperature measured by the first sensor (30) with the reference temperature and, controlled by the said means (42) of comparing the temperature measured by the first sensor (30) with the reference temperature, means (36) of increasing the ratio of the flow rate of fuel to the flow rate of oxidizing agent introduced into the furnace (1) when the smoke temperature measured by the first sensor (30) is below the reference temperature.

6. Method according to claim 2, characterized in that after the said reduction, the temperature measured at the first point (31) is also compared with a reference temperature and in that the ratio of the flow rate of fuel to the flow rate of oxidizing agent introduced into the furnace (1) is increased when the temperature of the smoke measured at the first point (31) is below the reference temperature.

7. Method according to claim 3, characterized in that after decreasing the ratio of the flow rate of fuel to the flow rate of the oxidizing agent, the temperature measured at the first point (31) is also compared with a reference temperature and in that the ratio of the flow rate of fuel to the flow rate of oxidizing agent introduced into the furnace (1) is increased when the temperature of the smoke measured at the first point (31) is below the reference temperature.

8. Device for operating a furnace comprising a flue pipe for discharging the smoke, means (19) of introducing ambient air into the said flue pipe (11) and a smoke extractor (16) arranged downstream of the said means (19) of introducing ambient air, for implementing the method according to claim 2, characterized in that it further comprises a first and a second sensor (30, 32) for measuring the smoke temperature, the first (30) of which is placed close to the outlet (9) of the furnace, and the second (32) of which is placed in the flue pipe (11), downstream of the first sensor (30), means (34) of subtracting the temperature measured by the second sensor (32) from the one measured by the first sensor (30), means (35) of comparing the result of the subtraction with a datum value ΔT and, controlled by the said comparison means (35), means (36) of reducing the ratio of the flow rate of fuel to the flow rate of oxidizing agent introduced into the furnace (1) when the result of the subtraction is below a datum value.

9. Device for operating a furnace comprising a flue pipe for discharging the smoke, means (19) of introducing ambient air into the said flue pipe (11) and a smoke extractor (16) arranged downstream of the said means (19) of introducing ambient air, for implementing the method according to claim 3, characterized in that it further comprises a first and a second sensor (30, 32) for measuring the smoke temperature, the first (30) of which is placed close to the outlet (9) of the furnace, and the second (32) of which is placed in the flue pipe (11), downstream of the first sensor (30), means (34) of subtracting the temperature measured by the second sensor (32) from the one measured by the first sensor (30), means (35) of comparing the result of the subtraction with a datum value ΔT and, controlled by the said comparison means (35), means (36) of reducing the ratio of the flow rate of fuel to the flow rate of oxidizing agent introduced into the furnace (1) when the result of the subtraction is below a datum value.

10. Device for operating a furnace comprising a flue pipe for discharging the smoke, means (19) of introducing ambient air into the said flue pipe (11) and a smoke extractor (16) arranged downstream of the said means (19) of introducing ambient air, for implementing the method according to claim 1, characterized in that it further comprises a first and a second sensor (30, 32) for measuring the smoke temperature, the first (30) of which is placed close to the outlet (9) of the furnace, and the second (32) of which is placed in the flue pipe (11), downstream of the first sensor (30), means (34) of subtracting the temperature measured by the second sensor (32) from the one measured by the first sensor (30), means (35) of comparing the result of the subtraction with a datum value ΔT and, controlled by the said comparison means (35), means (36) of reducing the ratio of the flow rate of fuel to the flow rate of oxidizing agent introduced into the furnace (1) when the result of the subtraction is below a datum value, and also comprises means (44) of storing a reference temperature, means (42) of comparing the temperature measured by the first sensor (30) with the reference temperature and, controlled by the said means (42) of comparing the temperature measured by the first sensor (30) with the reference temperature, means (36) of increasing the ratio of the flow rate of fuel to the flow rate of oxidizing agent introduced into the furnace (1) when the smoke temperature measured by the first sensor (30) is below the reference temperature.

* * * * *